US005794664A

United States Patent [19]

Hasegawa et al.

[11] Patent Number: 5,794,664

[45] Date of Patent: Aug. 18, 1998

[54] WEFT FEEDING DEVICE FOR FLUID WEAVING MACHINE

[75] Inventors: Iwao Hasegawa; Toshiyuki Kidokoro, both of Tokyo, Japan

[73] Assignee: Micron Instrument Inc., Tokyo, Japan

[21] Appl. No.: 722,831

[22] Filed: Sep. 27, 1996

[30] Foreign Application Priority Data

Sep. 29, 1995 [JP] Japan ..... 7-254102
Jul. 12, 1996 [JP] Japan ..... 8-183760

[51] Int. Cl.[6] ..... D03D 47/36; D03D 47/38

[52] U.S. Cl. ..... 139/452; 139/450; 242/47.01; 226/150; 226/154

[58] Field of Search ..... 242/47.01; 226/150, 226/154, 155; 139/452, 450, 97, 100, 194

[56] References Cited

U.S. PATENT DOCUMENTS 2,693,235 11/1954 Kenworthy et al. ..... 226/155
4,792,074 12/1988 Bareis et al. ..... 226/154
4,947,897 8/1990 Binnersley et al. ..... 139/452

FOREIGN PATENT DOCUMENTS 50-148661 11/1975 Japan .
55-84442 6/1980 Japan .

*Primary Examiner*—Andy Falik
*Attorney, Agent, or Firm*—Wenderoth, Lind & Ponack

[57] ABSTRACT

A weft feeding device which alleviates an excessive tension acting on the weft upon feeding of the weft and inhibits breakage of the weft includes a gripper to grip the weft at prescribed times, a length measuring roller located downstream of the gripper, and a pinch roller to hold the weft against the roller at prescribed times. Opening and closing of the gripper is linked with movement of the pinch roller into and out of contact with the length measuring roller. A linear or a rotary solenoid is provided to operate the pinch roller and the gripper by a pulse width modulation method or a linear method.

11 Claims, 4 Drawing Sheets

WEFT FEEDING DEVICE FOR FLUID WEAVING MACHINE

FIELD OF THE INVENTION

The present invention relates to a weft yarn feeding motion in a liquid jet weaving machine, and more particularly, to a positive weft yarn feeding motion occurring in sync with operation of a gripper which operates in sync with movement of a pinch roller into contact with and away from a length measuring roller or feeding roller).

PRIOR ART DESCRIPTION

In a weft yarn feeding motion of a liquid jet weaving machine, it is difficult to adjust the operating timing of a length measuring roller and a gripper. The timing of opening the gripper should preferably be slightly before, or at the same time as, feeding by the length measuring roller. A premature feeding causes the weft to come off the gripper, thus making it impossible to measure the length, and causing the length to exceed the intended length by an amount corresponding to the length of time by which the ejection (or feeding) is premature.

When the gripper opening timing is late, breakage of the weft tends to easily occur between the gripper and the length measuring roller, thus resulting in a shorter measured length. For the purpose of facilitating adjustment of the timing, therefore, there is a demand for means permitting accurately linked operation of the pinch roller and the gripper.

Upon feeding of the weft, a tension is imparted to the weft under the effect of liquid injection. Upon holding of the weft by the gripper, therefore, an excessive tension is applied to the weft, thus forming a cause of end breakage. There is therefore a demand for the development of a weft feeding motion which alleviates an excessive tension acting on the weft upon feeding and solves the cause of end breakage.

SUMMARY OF THE INVENTION

Therefore, an object of the present invention is to provide a weft yarn feeding apparatus provided with a gripper for holding and releasing the weft, and a length measuring roller (or feeding roller), and which prevents shifting of gripper holding timing upon feeding of the weft, prevents the weft from coming off the gripper, prevents breakage of the weft between the pinch roller and the gripper, alleviates excessive tension applied to the weft, and is less susceptible to weft breakage overall.

In the weft yarn feeding apparatus of the present invention, the weft is fed to a nozzle while being held between a length measuring roller and a pinch roller. The pinch roller is movable toward and away from the length measuring roller, and opening and closing of the gripper is controlled to be in sync with movement of the pinch roller. This arrangement does not require a separate actuator for operating the gripper as in the conventional apparatus. It is also possible to eliminate a shifting of clamping timing of the gripper relative to the operation of the pinch roller, and to prevent the weft from coming off the gripper or breaking in the course between the pinch roller and the gripper.

DETAILED DESCRIPTION OF THE INVENTION

The invention is directed to a weft yarn feeding device for feeding a weft to a nozzle while holding the weft between a length measuring roller (or feeding roller) and a pinch roller, and provides such advantages that opening and closing of the gripper is linked with movement of the pinch roller into and out of contact with the length measuring roller. A separate actuator is not required for operating the gripper as in the conventional motion arrangement. It is also possible to eliminate a shift of clamping timing of the gripper relative to the operation of the pinch roller, and to prevent the weft from coming off the gripper or breaking in the course between the pinch roller and the gripper.

According to a first embodiment, the pinch roller is provided at an end of a coupling arm and a gripper moving part is provided at the opposite end of the coupling arm which is mounted for pivotal movement around a pivot axis. The gripper is provided on the feed side of the length measuring roller, and opening and closing of the gripper is linked with the movement of the pinch roller into and out of contact with the length measuring roller by the action of a solenoid provided on the pinch roller side.

According to a second embodiment, the pinch roller is provided at an end of a coupling arm, a rotary solenoid is provided at the center of said arm, and a gripper moving part is provided at the opposite end of the coupling arm. The rotary solenoid causes alternate operation of the pinch roller and the gripper moving part, and is advantageous in that the pinch roller and the gripper can be operated with accurate timing by the coupling arm directly operated by the rotary solenoid, and a weft feeding device of a simple construction can be provided.

According to one aspect of the invention, the rotary solenoid alternately operates the pinch roller and the gripper and is controlled by a pulse width modulation (PWM) method. This is advantageous in that it allows reduction of the ON time of voltage, alleviates the initial operation of the gripper, buffers excessive tension applied to the weft, and prevents breakage of the weft by controlling the voltage applied to the rotary solenoid by using PWM upon feeding the weft and upon clamping the weft with the gripper, to achieve a discontinuous waveform having a narrow pulse width.

According to another aspect of the invention, opening and closing of the gripper is linked with the motion of the pinch roller moving into and out of contact with the length measuring roller. The solenoid operating the gripper is controlled by a linear control method, and this is advantageous in that it allows buffering of excessive tension acting on the weft and prevention of breakage of the weft by achieving a buttress waveform of voltage acting on the rotary solenoid by linear control.

Now, embodiments of the present invention will be described in detail below with reference to FIGS. 1 to 4.

Embodiment 1

Figure 1:
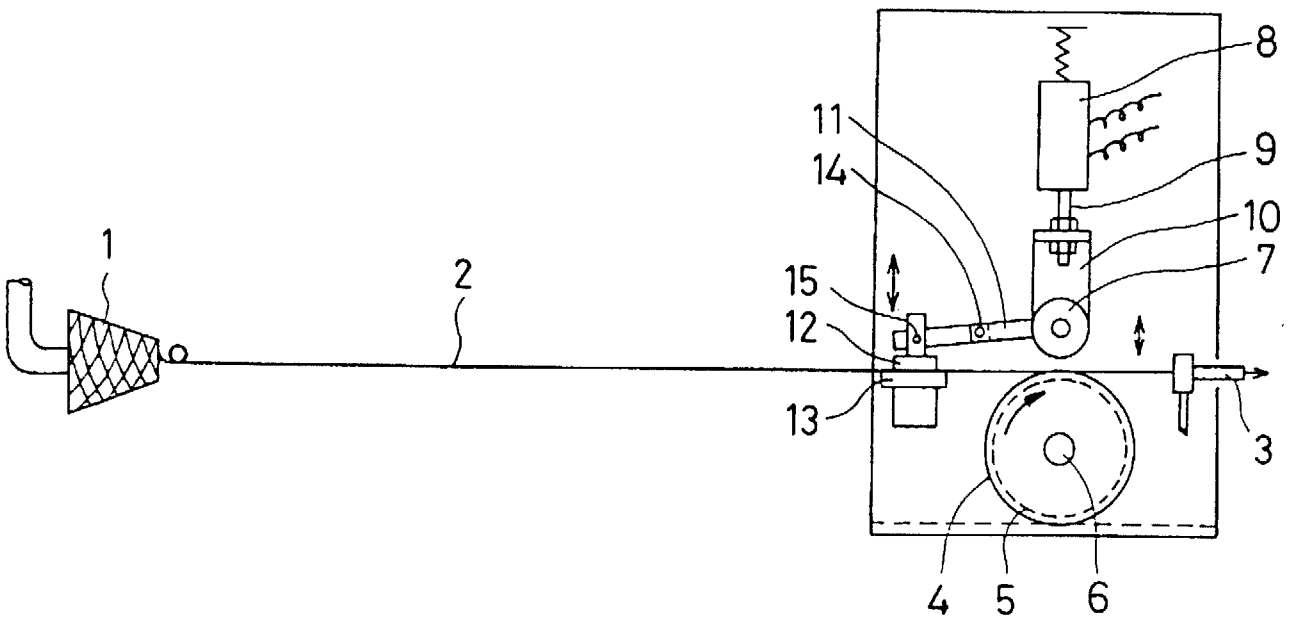
FIG. 1 shows a schematic elevation view illustrating a weft feeding device according to a first embodiment of the present invention.

FIG. 1 illustrates a weft feeding device of a first embodiment of the present invention. In FIG. 1, a length measuring roller (or feeding roller 4 is axially connected to a motor shaft 6 of a motor 5 and is engageable with a weft moving to a main nozzle 3 from a yarn feeder 1. The outer periphery of the length measuring roller 4 is formed with an elastic material so as to prevent slippage of the weft 2 relative to the length measuring roller 4 in the feeding direction when a pinch roller 7 is kept in contact therewith. The pinch roller 7 is attached to a pinch roller attachment plate 10 fitted to a shaft 9 of a solenoid 8, and further, is attached to an end of a coupling arm 11, and is moved into contact with the length measuring roller 4 by operation of the solenoid 8.

A gripper comprising a gripper moving part 12 and a gripper base 13 is provided on the yarn feeder 1 side of the length measuring roller 4. The gripper moving part 12 is provided through a fitting frame 15 to an end of the coupling arm 11 opposite the end to which the pinch roller 7 is attached. The coupling arm 11 is pivotally mounted for rotation about a shaft 14, and thus, when the pinch roller 7 is in contact with the length measuring roller 4, the gripper moving part 12 is in a position separated from the gripper base 13.

Functions of this embodiment of the present invention will now be described. FIGS. 2(A)–(H) illustrate an activation state of the main motor, an angle of rotation of the main shaft, reed movement, opening of the weft, timing of on (ejection) and off states of the nozzle, timing of on (measuring) and off states of the pinch roller solenoid, timing of on (gripping) and off states of the gripper and timing of on and off states of a cutter, respectively. Thus, the timing of the various procedures are performed in accordance with the procedure shown in the timing chart. When the motor of the weaving machine is turned on, oscillation of the reed causes a run of picking for each turn of the main shaft of the motor of the weaving machine. Together with picking of the weft, opening is performed alternately for the upper yarn and the lower yarn.

The motor 5 is switched on upon preparing for a weaving operation, and causes the length measuring roller 4 to turn in the direction of the arrow in FIG. 1, thus starting the operation.

The nozzle 3 is turned on when the warp forms an opening, and begins ejection (feeding) for weft insertion. At this point, the solenoid 8 is turned on and the pinch roller 7 comes into contact with the length measuring roller 4.

The weft 2 is clamped between the length measuring roller 4 and the pinch roller 7, and is fed toward the nozzle 3 by a length equal to that fed by the rotation of the length measuring roller 4 while the pinch roller is in contact therewith. The weft is inserted into the warp opening by ejection of the weft by the nozzle 3.

Upon weft insertion, the pinch roller 7 is moved by the action of the solenoid 8 into contact with the length measuring roller 4. During feeding of the weft, the coupling arm 11 oscillates around the shaft 14 so that the pinch roller 7 moves down toward the length measuring roller 4 and the gripper moving part 12 moves upward from the position in contact with the gripper base 13 to release the weft from the gripper. Upon weft insertion, therefore, the weft of a prescribed length as measured by the length measurement roller 4 is released from the yarn feeder 1.

Then, simultaneously with discontinuance of ejection from the nozzle 3, the drive solenoid 8 of the pinch roller 7 is turned off, thus releasing contact between the pinch roller 7 and the length measuring roller 4. As a result, the coupling arm 11 pivots around the shaft 14, and the gripper moving part 12 moves into contact with the gripper base 13 to clamp the weft therebetween.

Figure 2:
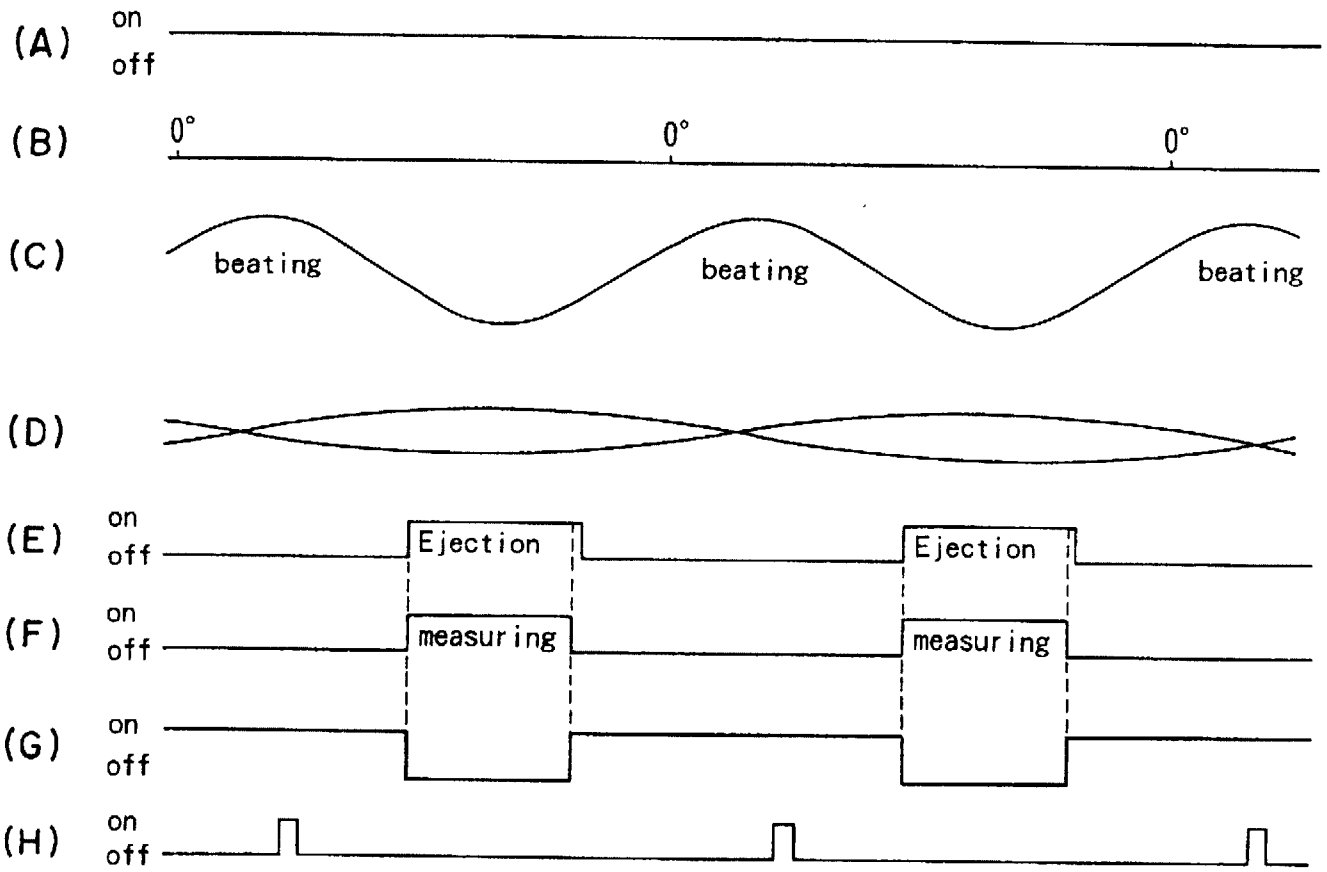
FIGS. 2(A)–(H) show timing charts for operation of the nozzle, the pinch roller and the gripper.

The timing of rotation of the roller 4, reed movement, opening of the warp turning on and off at the nozzle, turning on and off of the pinch roll solenoid and gripping by the and gripper must be accurately adjusted in accordance with the timing chart shown in FIG. 2. A defective adjustment may sometimes cause a shift in the relative timing. For example, the gripper opening occurs preferably slightly earlier than or at the same time as yarn feeding by the pinch roller. However if the gripper opens too early, the weft is freed from the gripper, thus making it impossible to measure length, resulting in an over-measurement of length for the prior ejection from the nozzle.

If the gripper opening occurs late, on the other hand, weft breakage occurs between the gripper and the pinch roller, resulting in a short length of weft.

When the gripper is provided between the length measuring roller and the nozzle, slackening of weft occurs. This results in weft coming off the gripper, and the ejection force instantaneously acts on the slackened weft to cause breakage.

In this embodiment of the present invention, the oscillation of the coupling arm moves the pinch roller into contact with and away from the length measuring roller and causes opening and closing of the gripper through direct motion mechanism. A shift of mutual timing therefore never occurs, and it is not necessary to adjust this timing.

Embodiment 2

Figure 3:
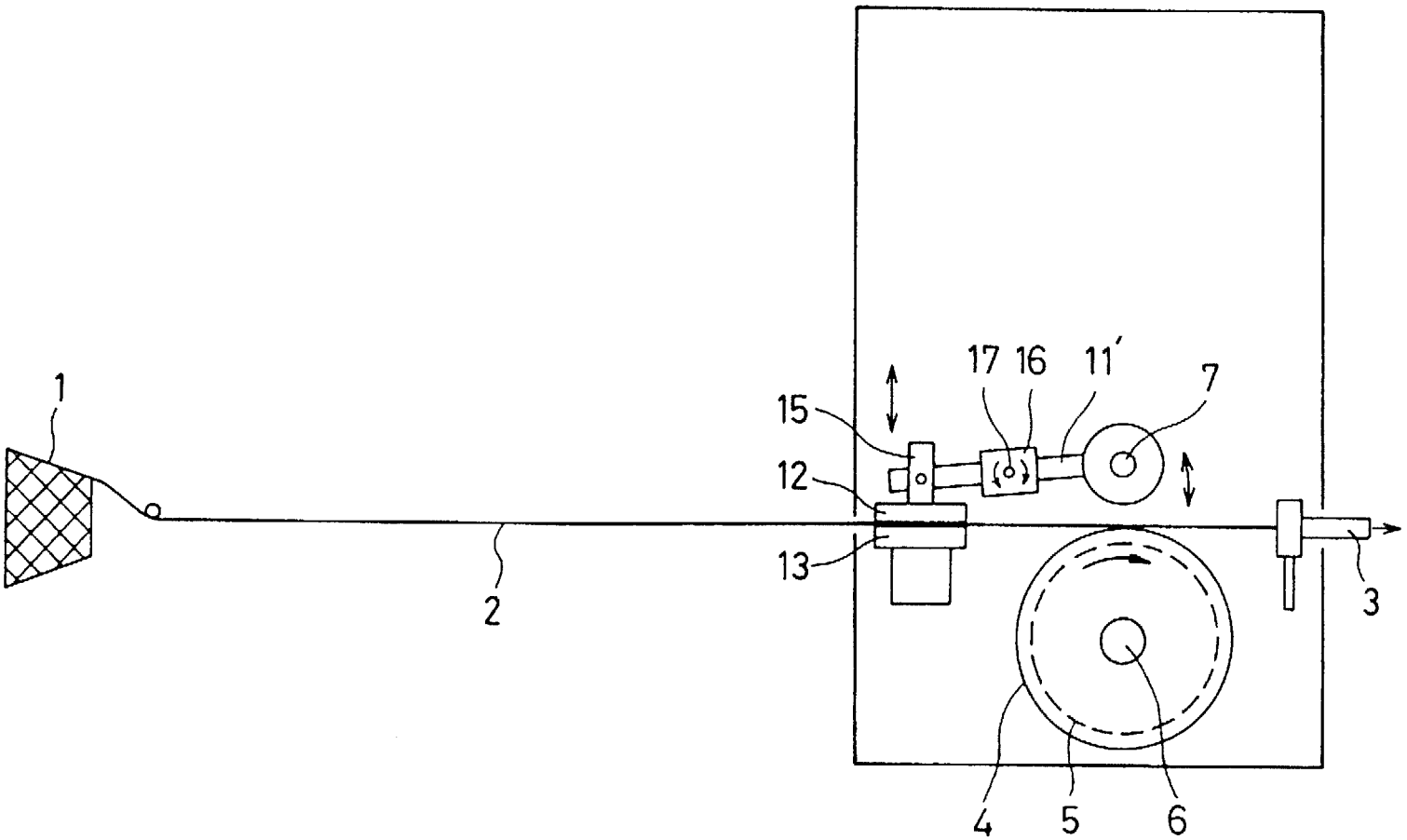
FIG. 3 shows a schematic elevation view illustrating a weft feeding device according to a second embodiment of the present invention.

FIG. 3 illustrates another embodiment of the weft feeding device of the present invention. For portions of this embodiment which are of the same configuration as the embodiment of FIG. 1, the description the description is omitted here and reference is made to the above description.

In FIG. 3, a weft feeding device comprising a length measuring roller (or feeding roller) 4, a pinch roller 7, and a gripper 12 is provided between a main nozzle 3 and a yarn feeder 1. In this embodiment, the pinch roller 7 is attached to an end of a coupling arm 11' of a rotary solenoid 16, and comes into contact with the length measuring roller 4 under the action of the rotary solenoid 16.

A gripper means comprising a gripper moving part 12 and a gripper base 13 is provided on the yarn feeder 1 side of the length measuring roller 4. The gripper moving part 12 is provided at an end of the coupling arm 11' opposite the end to which the pinch roller is attached. The coupling arm 11' is pivotally mounted for movement about a shaft 17 of the rotary solenoid 16, and when the pinch roller 7 is in contact with the length measuring roller 4, the gripper moving part 12 is separated from the gripper base 13.

An outline of a control method for operating the rotary solenoid of the present invention is described below with reference to FIG. 4.

Figure 4A:
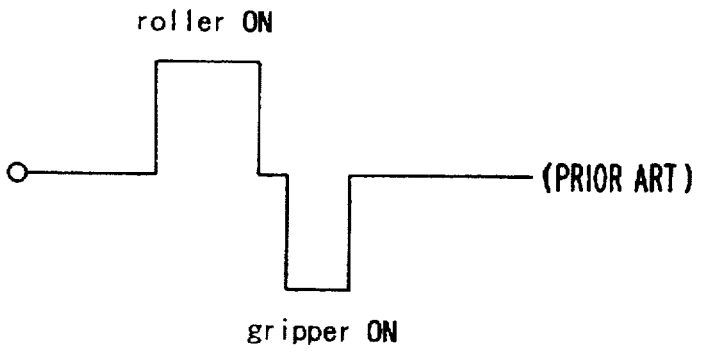
FIGS. 4*a*–4*c* are schematic illustrations showing a control method for operating a rotary solenoid.

In FIG. 4*a*, when positive voltage is applied to the rotary solenoid 16, the pinch roller 7 side of the rotary solenoid is actuated, and when negative voltage is applied, the gripper 12 side of the rotary solenoid is actuated. First, when no voltage is applied, the gripper is in the maintained in a closed state by the action of a magnet. When voltage in the positive direction is applied to the solenoid 16, the pinch roller 7 is moved into contact with the length measuring roller 4 which is always rotating, thus feeding the weft 2 of a certain length toward the nozzle 3.

Then, when negative voltage is applied to the solenoid 16 after a prescribed time period, the gripper moving part 12 is operated via the coupling arm 11' to clamp the weft 2 between the gripper moving part 12 and the gripper base 13. At this point, since an inertia force is imparted to the weft by a fluid fed by the nozzle, an excessive tension is applied to the weft upon clamping the weft by the gripper.

In the present invention, therefore, the rotary solenoid is controlled by a PWM (Pulse Width Modulation) method to alleviate operation of the gripper moving part 12 and to buffer the excessive tension applied to the weft.

Figure 4B:
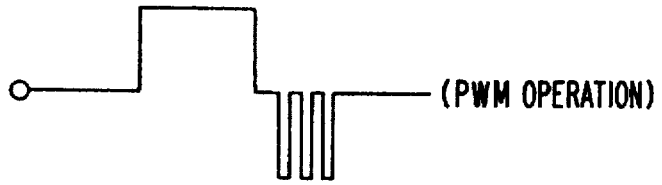

FIG. 4*b* illustrates a control pulse waveform of the rotary solenoid based on the PWM method. By adopting the PWM method, the rotary solenoid 16 is controlled with a narrow-width discontinuous pulse waveform of voltage. As compared with the control with the conventional or prior art pulse waveform as shown in FIG. 4*a*, it is possible to reduce the ON time of voltage, alleviate initial operation of the gripper, buffer an excessive tension acting on the weft, and prevent breakage of the weft.

Figure 4C:
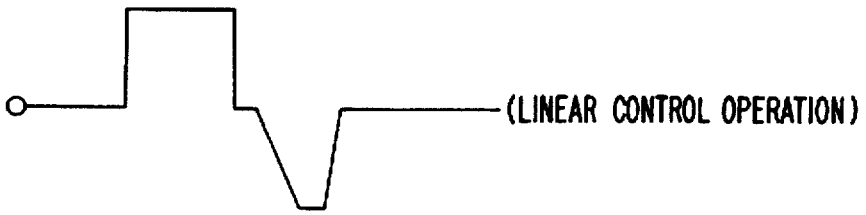

FIG. 4*c* illustrates an embodiment of the linear control method which comprises applying linear control to voltage, and controlling the rotary solenoid with the use of a buttress waveform pulse.

The control pulse of the rotary solenoid 16 is provided by means of a buttress waveform pulse, and voltage which is low in the initial stage of operation gradually increases. This type of control therefore alleviates initial operation of the rotary solenoid, and alleviates initial operation of the pinch roller and the gripper.

The weft feeding device of the present invention is an apparatus for feeding a weft by means of a nozzle by clamping the weft with a length measuring roller and the pinch roller, in which opening and closing of the gripper is controlled to correspond with the movement of the pinch roller into contact with and away from the length measuring roller. It is not therefore necessary to provide actuating means such as an actuator for operating the gripper as has been necessary in the conventional method. It is furthermore possible to eliminate a shift of clamping timing of the gripper relative to the operation of the pinch roller, and prevent the weft from coming off the gripper and breakage of the weft between the pinch roller and the gripper from occurring. By using the PWM method or the linear control method for controlling the rotary solenoid for alternately operating the pinch roller and the gripper, the rotary solenoid operates by a narrow pulse width discontinuous waveform voltage or a buttress waveform voltage, and this alleviates initial operation of the rotary solenoid and initial operation of the gripper operated by the rotary solenoid. This reduces excessive tension acting on the weft, and prevents of breakage of the weft.

What is claimed is:

1. A weft feeding device for use in a fluid weaving machine, comprising:

a yarn feed roller;

a pinch roller mounted for movement into contact with and away from said yarn feed roller;

an openable and closable gripper having a gripper base and a gripper movable part operably linked with said pinch roller;

a solenoid operably coupled with said pinch roller for actuating said pinch roller to move into contact with and away from said yarn feed roller;

a coupling arm pivotable about a pivot axis and having first and second ends; and wherein said gripper movable part is provided at said first end of said coupling arm, and said pinch roller is provided at said second end of said coupling arm, such that actuation of said pinch roller by said solenoid to move said pinch roller relative to said yarn feed roller causes movement of said gripper movable part relative to said gripper base.

2. A weft feeding device as recited in claim 1, wherein said gripper is provided on a yarn feed-in side of said yarn feed roller; and said solenoid is coupled with said coupling arm on a pinch roller side thereof.

3. A weft feeding device as recited in claim 2, wherein said solenoid and said coupling arm together constitute a mechanism for alternately moving said pinch roller into contact with said yarn feed roller and moving said movable gripper part toward said gripper base.

4. A weft feeding device as recited in claim 1, wherein said solenoid comprises a rotary solenoid coupled to a center portion of said coupling arm.

5. A weft feeding device as recited in claim 4, wherein said solenoid and said coupling arm together constitute a mechanism for alternately moving said pinch roller into contact with said yarn feed roller and moving said movable gripper part toward said gripper base.

6. A weft feeding device as recited in claim 1, wherein said solenoid and said coupling arm together constitute a mechanism for alternately moving said pinch roller into contact with said yarn feed roller and moving said movable gripper part toward said gripper base.

7. A weft feeding device as recited in claim 1, wherein said solenoid comprises a means for controlling actuation of said gripper according to a pulse width modulation operation.

8. A weft feeding device as recited in claim 1, wherein said solenoid comprises a means for controlling actuation of said gripper according to a linear control operation.

9. A weft feeding device as recited in claim 1, further comprising a yarn feeder provided upstream of said gripper and said yarn feed roller for feeding yarn to said yarn feed roller.

10. A weft feeding device as recited in claim 9, further comprising a nozzle provided downstream of said yarn feed roller for ejecting yarn fed from said yarn feed roller into an open warp.

11. A weft feeding device as recited in claim 1, further comprising a nozzle provided downstream of said yarn feed roller for ejecting yarn fed from said yarn feed roller into an open warp.

* * * * *